US006299017B1

(12) United States Patent
Hill

(10) Patent No.: US 6,299,017 B1
(45) Date of Patent: Oct. 9, 2001

(54) DISPENSING OF LAMINAR ARTICLES

(75) Inventor: Simon David Julian Hill, Wiesbaden (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/380,512

(22) PCT Filed: Feb. 27, 1998

(86) PCT No.: PCT/IB98/00245

§ 371 Date: Feb. 3, 2000

§ 102(e) Date: Feb. 3, 2000

(87) PCT Pub. No.: WO98/39239

PCT Pub. Date: Sep. 11, 1998

(30) Foreign Application Priority Data

Mar. 6, 1997 (EP) ..... 97103690

(51) Int. Cl.[7] ..... B65H 1/00
(52) U.S. Cl. ..... 221/63; 206/494
(58) Field of Search ..... 221/33, 45, 46, 221/48, 63; 206/494, 449, 812

(56) References Cited

U.S. PATENT DOCUMENTS

| | | | | |
|---|---|---|---|---|
| 2,890,791 | | 6/1959 | Wenzel . | |
| 3,007,605 | | 11/1961 | Donovan . | |
| 3,012,692 | * | 12/1961 | Petersen | 221/63 |
| 3,021,022 | | 2/1962 | Schwartz . | |
| 3,239,097 | | 3/1966 | Bates et al. . | |
| 3,576,243 | | 4/1971 | Trunick | 221/63 |
| 4,200,200 | | 4/1980 | Hein, III et al. | 221/48 |
| 4,458,810 | | 7/1984 | Mahoney | 206/210 |
| 4,478,354 | * | 10/1984 | Notheis | 221/63 |
| 4,526,291 | | 7/1985 | Margulies | 221/63 |
| 4,574,952 | | 3/1986 | Masui | 206/494 |
| 4,623,074 | | 11/1986 | Dearwester | 221/48 |
| 4,681,240 | | 7/1987 | Wyant | 221/48 |
| 5,219,421 | | 6/1993 | Tipping | 221/63 |
| 5,316,177 | | 5/1994 | Boldt | 221/63 |
| 5,516,001 | * | 5/1996 | Muckenfuhs et al. | 221/63 |
| 5,927,488 | * | 7/1999 | Gray | 221/63 |

* cited by examiner

*Primary Examiner*—Kenneth W. Noland
(74) *Attorney, Agent, or Firm*—Peter D. Meyer

(57) ABSTRACT

The present invention relates to a dispensing face (10) for a dispensing unit (11) comprising at least one stack of laminar articles (12) wherein the dispensing face (10) is continuous, comprises lateral outer edges (13, 14) and longitudinal outer edges (15, 16) and not less than two orifices (17, 18). The first orifice (17) and the second orifice (18) are coplanar, the second orifice (18) being independent of the first orifice (17) and being disposed at a distance not greater than 20 millimetres from the first orifice (17).

5 Claims, 2 Drawing Sheets

DISPENSING OF LAMINAR ARTICLES

FIELD OF THE INVENTION

The present invention relates to a means for facilitating the dispensing of laminar articles.

BACKGROUND OF THE INVENTION

A variety of packaging solutions exists for laminar articles destined for cosmetic, toilet and cleaning purposes. For simplicity, the ensuing description focuses on tissues, but what is said must be understood in light of the foregoing comment about the wider applicability of the present invention. Tissues may be supplied dry, with lotion, or moistened. Such tissues are typically rectangular in shape and supplied in discrete sheets from a dispensing unit. The dispensing unit has on one of its faces, typically on the upper face, at least one orifice, through which individual sheets can be removed by a consumer.

Early tissue dispensing units were of the "reach-in" type. The consumer was forced to insert his or her fingers through the dispensing orifice, grasp a tissue, and pull it out through the dispensing orifice. Examples of reach-in dispensers and improvements can be found in U.S. Pat. Nos. 3,021,002, 3,576,243 and 4,458,810. Over time, the desire for increased convenience led to sequential or pop-up dispensers. In a "pop-up" dispensing unit, a tissue usually extends through the dispensing orifice to an elevation above that of the dispensing unit. The consumer simply grasps the exposed portion of the tissue, without the necessity of inserting fingers through the dispensing orifice. In pop-up dispensing, each tissue has a leading portion. which first passes through the dispensing orifice, and a trailing portion that later passes through the dispensing orifice. Typically, the trailing portion of a first tissue to be dispensed overlaps the leading portion of the next tissue to be dispensed. The overlap is generally measured parallel to the direction of withdrawal of the tissues through the dispensing orifice. The overlap is usually, but not necessarily, the same for each tissue and constant throughout the width of each tissue. As the first tissue is withdrawn by the consumer, the leading portion of the next tissue is pulled though the orifice for later dispensing.

The sequential withdrawal of the succeeding tissue through the dispensing orifice occurs due to interfolding of adjacent tissues. The tissues are folded against one another in a variety of configurations, so that the friction of the trailing portion of the withdrawn sheet against the succeeding sheet pulls the leading portion of the succeeding sheet though the dispensing orifice. Apparatuses for interfolding are complex and expensive. Even when the interfolding is properly accomplished, the tissue to be dispensed frequently falls back through the dispensing orifice. The problem is exacerbated with relatively tall dispensing units, which are often consumer preferred. The usable height of the dispensing unit is often limited to the length of the overlap of the interfolded tissues. This limitation occurs due to the leading and trailing portions of adjacent tissues unfolding inside a dispensing unit taller than the overlap, then the second tissue falls back into the dispensing unit.

Potential solutions to the fallback problem result in additional expenses when trying to dispense interfolded tissues. For example, the prior art has suggested outlining the dispensing orifice to prevent improper dispensing. Yet other attempts in the prior art have disposed adhesive on the film outlining the dispensing orifice. Still further attempts replace the film with paper for environmental reasons. Of course, the use of such film, adhesive and paper represent additional costs, which are ultimately passed onto the consumer. Examples of such attempts in the art are U.S. Pat. Nos. 3,007,605; 3,239,097; 4,200,200; 4,681,240; 5,316,177.

Attempts to improve pop-up dispensing units also include the attachment of the tissues to the removable upper portion of the dispensing unit, so that the first tissue is pulled through the dispensing orifice when the unit is opened. GB 2 163 131 is a case in point. Still another attempt in the art provides a lapping flap which allegedly holds partially dispensed laminar articles against falling back into the dispensing unit. A commercially successful improvement is the dual mode dispensing unit, which allows for either pop-up or reach-in dispensing. Examples of such include U.S. Pat. Nos. 2,890,791, 4,574,952 and 4,623,074.

One problem frequently encountered in the pop-up dispensing units of the prior art is the transition from the reach-in dispensing mode in which the product is shipped to the pop-up dispensing mode, which is preferred by the consumer. The dispensing orifice must be large enough to allow the consumer to reach his or her fingers therethrough to grasp the tissue and begin the pop-up dispensing process. The dispensing orifice, however, must be small enough to constrict the tissues dispensed therethrough, so that a tissue may be separated from the succeeding tissues.

One attempt to resolve the diametrically opposed needs for large and small dispensing orifices has been to make a dispensing orifice that is self threading. As such, the large and small dispensing orifices are interconnected such that the smaller dispensing orifice is contiguous with the larger dispensing orifice. The consumer reaches through the larger dispensing orifice, grasps the tissue, pulls it through the dispensing orifice, and threads it into the smaller dispensing orifice. The consumer then separates the grasped tissue from the succeeding tissue. When the succeeding tissue is needed, it is likewise dispensed and separated from the next succeeding tissue. One significant drawback is that the small orifice does not provide sufficient frictional engagement with the tissues to prevent them from falling back into the package. The problem is further complicated with relatively tall dispensing units. If the tissues are not interfolded, but rather are connected by perforations, the stack of tissues in the taller dispensing unit will eventually become depleted, or nearly so. As fewer tissues remain in the bottom of the dispensing unit, a greater portion of the tissue hangs from the dispensing orifice to the top of the stack at the bottom of the dispensing unit. When this occurs, the weight of the free portion of the tissue increases, thus making it more likely that the frictional engagement with the dispensing orifice is insufficient to prevent the tissue from falling back into the dispensing unit. When fallback occurs, the consumer is frustrated by not only having to reach through the dispensing orifice to retrieve the tissue and start the pop-up dispensing process all over again, but is doubly frustrated because the tissue is well below the dispensing orifice, having fallen to nearly the bottom of the dispensing unit.

Other attempts in the art, as described in U.S. Pat. Nos. 4,526,291 and 5,219,421, show a tissue dispensing unit having three slits, a longitudinally oriented slit emanating from a large orifice and which terminates at lateral slits. The longitudinal slit is flanked by two arcuately shaped peripheral slits in order to create hinges. The drawback to this arrangement is that the large wings formed by the hinges occupy an excessively large area of the top of the dispensing unit. A further teaching in the art shows a dispensing orifice tapering to a single slit which intercepts a second slit transverse thereto. This teaching, however, does not show how to optimise the slits relative to each other, or relative to the rest of the dispensing orifice. A recent attempt as in U.S. Pat. No. 5,516,001 teaches a dispensing orifice spaced apart from a reach-in orifice and connected by an isthmic connection. The isthmic connection has two opposed ends, one end being juxtaposed with each of the orifices. The teaching leads to a disadvantage associated with the length of the leading edge of the tissue. Typically, the edge of the tissue tends to wander into the reach-in orifice, away from the pinching area of the dispensing orifice resulting in erratic dispensing and a high incidence of long sections of tissues protruding from the reach-in orifice. This is clearly an undesirable side-effect since the long leading edges of the tissues can give rise to an impression that the tissues are not stored in a satisfactory hygienic manner, that contamination can easily result from the external surrounds, that the edge of the tissue will interfere with the closing mechanism of the dispensing unit, and that in the case of moisture-impregnated tissues, moisture retention can be severely affected.

It has now been discovered that the present invention can offer a simple and very attractive solution to the above shortcomings of the prior art by providing at least two functionally different orifices that can be positioned on one of the faces of the dispensing unit in order to guarantee easy access to and retrieval of the laminar articles without affecting dispensing performance. The first orifice is designed solely for the dispensing of laminar articles such as tissues. In order to initiate the dispensing process, the top tissue on the stack is easily accessible through the use of the second orifice. Furthermore, in the eventuality of fallback, rethreading is greatly simplified with the aid of the second orifice, which is designed to comfortably permit the fingers of the consumer to execute the necessary step in order to recommence the dispensing process through the first orifice.

SUMMARY OF THE INVENTION

The present invention focuses on a dispensing face for a dispensing unit comprising at least one stack of laminar articles wherein the dispensing face is continuous. The dispensing face comprises lateral outer edges and longitudinal outer edges and not less than two orifices. The first orifice and the second orifice are coplanar, the second orifice being independent of the first orifice and being disposed at a distance not greater than 20 millimeters from the first orifice. In a preferred embodiment of the present invention, the second orifice is contiguous with at least one of the lateral outer edges or longitudinal outer edges of the dispensing face. The second orifice comprises at least an arcuate portion. In further embodiments of the present invention, the dispensing face can be an integral part of the dispensing unit or the dispensing face can be a separate entity from the dispensing unit.

BRIEF DESCRIPTION OF THE DRAWINGS

It is believed that the invention will be better understood from the foregoing description in conjunction with the accompanying drawing in which.

DETAILED DESCRIPTION OF THE INVENTION

Figure 1:
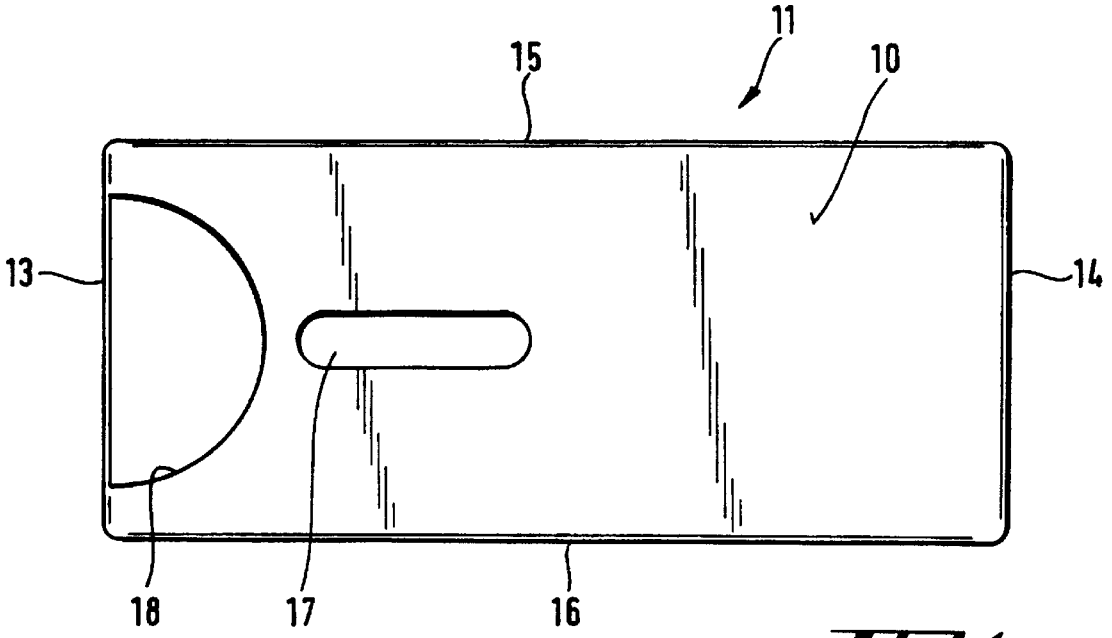
FIG. 1 illustrates a plan view of a dispensing face according to a preferred embodiment of the present invention.

According to the present invention, the dispensing unit can either be disposable or refillable. As used herein, the term "disposable" implies that the dispensing unit should be discarded after laminar articles supplied therewith are depleted. The dispensing unit is not intended to be restocked with laminar articles. Likewise, each laminar article is discarded after use, and is not laundered, or otherwise restored. As used herein, the term "refillable" refers to the capability of the dispensing unit to be restocked with laminar articles after the supply has been depleted.

A dispensing unit may have walls and may be parallelepipedly shaped although this is not limiting. The dispensing unit may be a portable, lightweight packet; a rigid container; a semi-rigid container; a flexible container; a flexible box; or any combination thereof and may comprise any suitable material known to the man skilled in the art. With reference to the drawings, typically, a dispensing unit 11 comprises at least one face, which is referred to as a dispensing face 10. At least one stack of laminar articles 12 such as a stack of tissues 12 is disposed in the dispensing unit 11. The tissues 12 are releasably attached to each other. Each tissue 12 is releasably attached to both adjacent tissues 12 by any releasable attachment means, which allows easy separation to occur as the tissue 12 is being dispensed or after the tissue 12 is withdrawn through the first orifice 17. The releasable attachment means may comprise means such as adhesion, friction, cohesion or other forces, which releasably attach adjacent tissues 12. The tissues 12 can be dry or chemically impregnated in a dry form. Alternatively, the tissues 12 can be impregnated with a liquid-cleansing solution. The liquid-cleansing solution can be an aqueous solution or an emulsion in which the continuous phase is aqueous or an oil-based solution in which, for example, the continuous phase is oil. Alternatively, the tissues 12 may only contain non-aqueous liquids such as alcohols, ketones and oils. One skilled in the art will recognise that the dispensing unit 11 will be liquid/gas impervious if the tissues 12 are wetted.

From FIG. 1, it can be seen that the dispensing face 10 is continuous and comprises lateral outer edges 13, 14 and longitudinal outer edges 15, 16 and not less than two orifices 17, 18, that is a first orifice 17 and a second orifice 18. The first orifice 17 is designed solely for the dispensing of the tissues 12 and is of a size relative to the tissues 12. The size is designed to constrict the tissues 12 as they are pulled through the first orifice 17. Tissues 12 are considered to be constricted when they are forced to touch the dispensing face 10 intercepted by the first orifice 17 upon withdrawal of the tissue 12 by the consumer. As used herein, the term "withdrawal" refers to a tissue 12 that has passed completely from inside the dispensing unit 11 to outside the first orifice 17. The second orifice 18 functions as a starting point for the dispensing process, and is particularly useful in the eventuality of fallback. The first orifice 17 and the second orifice 18 are coplanar. The second orifice 18 is independent of the first orifice 17 and is disposed at a distance not greater than 20 millimeters from the first orifice 17. Such a defined distance enables the advantage of the second orifice 18 in relation to the first orifice 17 to be fully exploited.

In a preferred embodiment of the present invention, the second orifice 18 is contiguous with at least one of the lateral outer edges 13, 14 or longitudinal outer edges 15, 16 of the dispensing face 10. The second orifice 18 preferably comprises at least an arcuate portion, although it may comprise a variety of shapes. One skilled in the art will appreciate that the examples include semi-circles, ellipses, ovals, polygons, non-axisymmetric shapes etc., and any combinations thereof, but that the examples are neither all-inclusive nor exhaustive of the shapes that could be adopted for the second orifice 18. In FIG. 1, the second orifice 18 is represented in the form of a semi-circle. The first orifice 17 can adopt any appropriate shape that ensures effective and reasonable dispensing. Such plan-view shapes for the first orifice 17 include but are in no way limited to a slit, a H shape, openings with wings, polygons, semi-circles, ellipses, ovals, nonaxisymmetric shapes etc. As used herein, a "slit" refers to a severing between two otherwise contiguous pieces of material. The second orifice 18 is deliberately larger in area than the first orifice 17. Typically, the dimensions of the second orifice 18 can extend to at least half the dimensions of the dispensing face 10. Nevertheless, it is desirable that the second orifice 18 be as small as possible in order to avoid causing adverse effects to the tissues 12. Therefore, the surface area of the first orifice 17 can range from 9 square centimeters to 81 square centimeters and the surface area of the second orifice 18 can range from 0.45 square centimeters to 12 square centimeters. For the embodiment as illustrated in FIG. 1, the dispensing face 10 may comprise a first orifice 17 that is generally oblong in shape having dimensions of about 5.5 centimeters in length and 2 centimeters in width and a second orifice 18 that is semi-circular in shape with a radius of 3.5 centimeters. The first orifice 17 is disposed 0.5 centimeters away from the second orifice 18. The dispensing face 10 for this particular embodiment is typically 15.5 centimeters in length by 90 centimeters in width.

Figure 2:
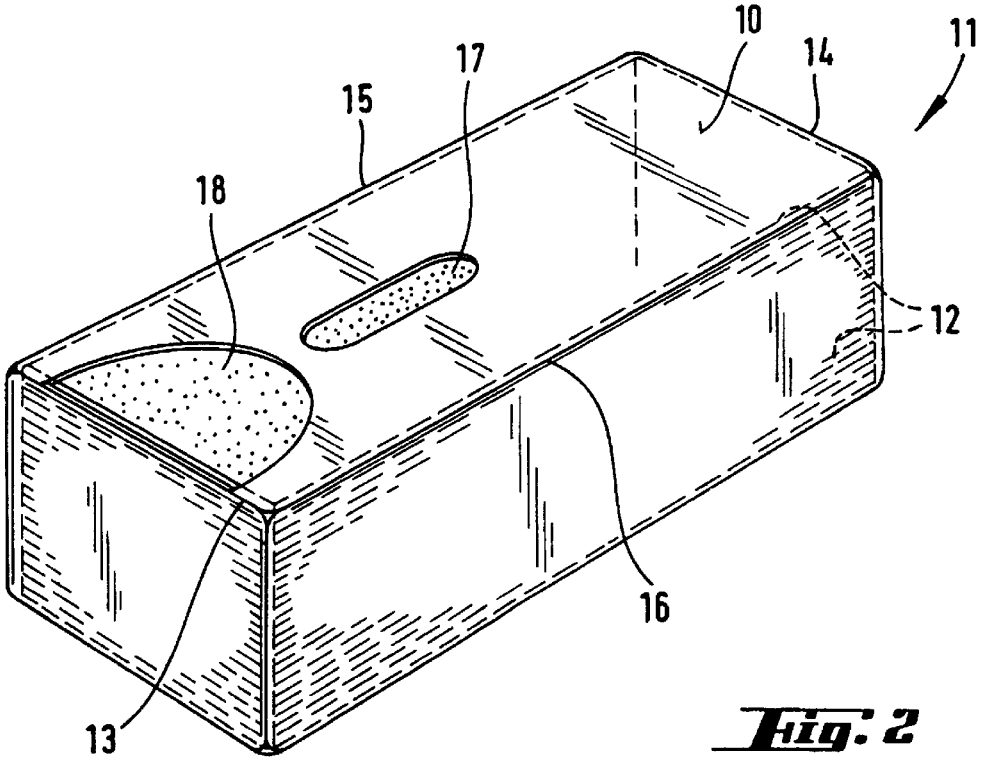
FIG. 2 shows a perspective view of a preferred dispensing unit according to the present invention.
Figure 3:
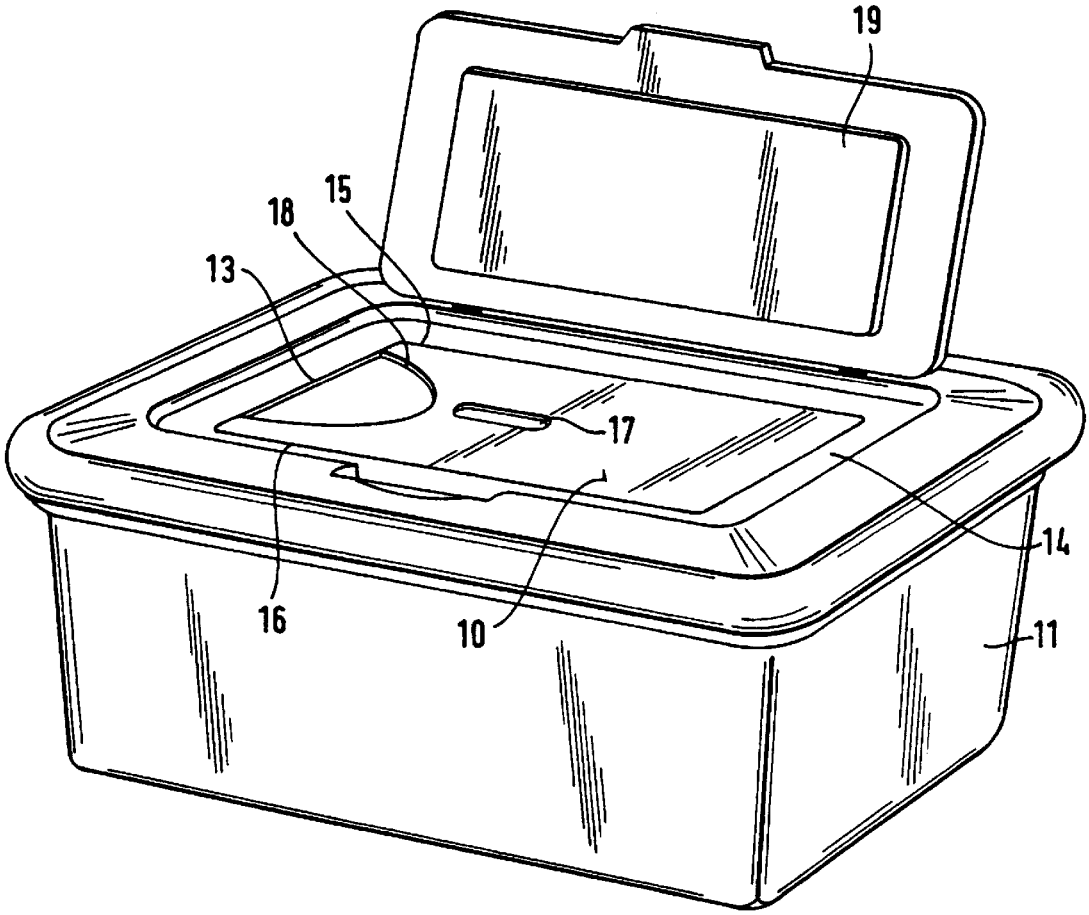
FIG. 3 shows a perspective view of a further preferred dispensing unit according to the present invention.

In another preferred embodiment of the present invention as shown in FIG. 2, the dispensing face 10 is an integral part of the dispensing unit 11 as for example in a tissue box. In yet another preferred embodiment of the present invention as illustrated in FIG. 3, the dispensing face 10 is a separate entity from said dispensing unit 11. In such a case, the dispensing unit 11 may comprise a lid 19 which overlies the dispensing face 10.

In operation, the arrangement, as described herein, allows the consumer to insert his or her fingers into the dispensing unit 11 through the second orifice 18 to gain access to the top tissue 12 of the stack and to thread the tissue 12 through the first orifice 17. The tissue 12 is then withdrawn from the dispensing unit 11 through the first orifice 17. The first tissue 12 is separated from the adjacent or succeeding tissue 12. The first tissue 12 may be separated by overcoming the adhesive forces if the tissues 12 are adhesively joined, or exceeding the tensile strength of any of the other releasable attachment means which may have been selected.

What is claimed is:

1. Dispensing face (10) for a dispensing unit (11) comprising at least one stack of laminar articles (12) wherein said dispensing face (10) is continuous, said dispensing face (10) comprising lateral outer edges (13, 14) and longitudinal outer edges (15, 16) and not less than two orifices (17, 18) characterized in that said first orifice (17) and said second orifice (18) are coplanar, said second orifice (18) being independent of said first orifice (17) and being disposed at a distance not greater than 20 millimeters from said first orifice (17) and wherein the surface area of said first orifice (17) ranges from 9 square centimeters to 81 square centimeters and the surface area of said second orifice (18) ranges from 0.45 square centimeters to 12 square centimeters.

2. Dispensing face (10) for a dispensing unit (11) according to claim 1 wherein said second orifice (18) is contiguous with at least one of said lateral outer edges (13, 14) or said longitudinal outer edges (15, 16).

3. Dispensing face (10) for a dispensing unit (11) according to claim 2 wherein said second orifice (18) comprises at least an arcuate portion.

4. Dispensing face (10) for a dispensing unit (11) according to claim 1 wherein said dispensing face (10) is an integral part of said dispensing unit (11).

5. Dispensing face (10) for a dispensing unit (11) according to claim 4 wherein said dispensing face (10) is a separate entity from said dispensing unit (11).

* * * * *